United States Patent [19]

Meadows

[11] Patent Number: 4,930,636

[45] Date of Patent: Jun. 5, 1990

[54] STACKABLE CONTAINER ASSEMBLY

[76] Inventor: Marcia A. Meadows, 1520 Cumberland Ct. West, Palm Harbor, Fla. 34683

[21] Appl. No.: 381,816

[22] Filed: Jul. 19, 1989

[51] Int. Cl.[5] ..... B65D 21/02

[52] U.S. Cl. ..... 206/503; 206/821

[58] Field of Search ..... 206/821, 503

[56] References Cited

U.S. PATENT DOCUMENTS

| | | | |
|---|---|---|---|
| 2,326,414 | 8/1943 | Thompson | 206/821 |
| 2,687,231 | 8/1954 | Somers | 206/821 |
| 2,836,323 | 5/1958 | Robinson . | |
| 2,957,601 | 10/1960 | Novick | 206/821 |
| 3,180,537 | 4/1965 | Collins | 206/821 |
| 3,317,087 | 5/1967 | Landis | 206/821 |
| 3,369,691 | 2/1968 | Wei . | |
| 3,624,789 | 11/1971 | Peyser | 206/821 |
| 3,811,559 | 5/1974 | Carter . | |
| 3,885,672 | 5/1975 | Westenrieder | 206/821 |
| 4,116,332 | 9/1978 | Hartley | 206/821 |
| 4,228,897 | 10/1980 | Underwood | 206/821 |
| 4,595,099 | 6/1986 | Zaruba et al. . | |
| 4,598,832 | 7/1986 | Alonso . | |

*Primary Examiner*—George E. Lowrance
*Attorney, Agent, or Firm*—Jerry T. Kearns

[57] ABSTRACT

A stackable container assembly includes a plurality of equal diameter cylindrical containers. A connector for securing the containers in coaxial stacked relation includes first and second cylindrical side walls which intersect at a transverse circular partition. Circular undercut grooves are provided on each of the side walls and are dimensioned to frictionally engage top and bottom peripheral rims on the containers. The connector may form a removable lid for one of the containers and may be utilized to package snack food items for marketing.

2 Claims, 3 Drawing Sheets

STACKABLE CONTAINER ASSEMBLY

BACKGROUND OF THE INVENTION

1. Field of the Invention

The present invention relates to stackable container assemblies, and more particularly pertains to a stackable container assembly designed for use with cylindrical containers of the type utilized to package snack food items, such as potato chips sold under the trademark PRINGLES. These snack food items are typically sold in a large cylindrical container. Many individuals pack their lunch or snacks for transportation to work or school for later consumption. In order to facilitate transportation of these snack items, it is desirable that a smaller container dimensioned to hold a single serving be provided. This prevents over consumption of junk food items and also prevents the snack food items from being damaged during transportation. In order to facilitate this objective, the present invention discloses a stackable container assembly which utilizes a pair of cylindrical containers adapted for securement in coaxial stacked relation by a resilient connector. A smaller of the two containers may be utilized to transport individual servings of food items, while the connector serves as a removable lid for the larger of the two containers.

2. Description of the Prior Art

Various types of stackable container assemblies are known in the prior art. A typical example of such a container assembly is to be found in U.S. Pat. No. 2,836,323, which issued to S. Robinson on May 27, 1958. This patent discloses a tandem container assembly which utilizes a threaded connection to join two cylindrical containers. U.S. Pat. No. 3,369,691, which issued to T. Wei on Feb. 20, 1968, discloses a plurality of stacked cylindrical food containers secured by a connector having locking pins selectively receivable in bayonet-type slots. U.S. Pat. No. 3,811,559, which issued to J. Carter on May 21, 1974, discloses a stackable series of insulated containers for transporting food items. U.S. Pat. No. 4,595,099, which issued to J. Zaruba et al on Jun. 17, 1986, discloses a stackable container assembly for preparing and storing ice cream sandwiches. The individual container assemblies include interlocking flanges for securing the units in vertically stacked relation. U.S. Pat. No. 4,598,832, which issued to I. Alonso on Jul. 8, 1986, discloses a system for coupling cylindrical sections which utilizes an internally threaded connecting ring.

While the above mentioned devices are directed to stackable container assemblies, none of these devices utilize a connector having first and second cylindrical side walls which intersect at a central transverse circular partition and include circular undercut grooves for engagement with top and bottom rims of a pair of vertically stacked cylindrical containers. Additionally, none of the aforesaid devices disclose a resilient connector which also functions as a removable container top. Inasmuch as the art is relatively crowded with respect to these various types of stackable container assemblies, it can be appreciated that there is a continuing need for and interest in improvements to such stackable container assemblies, and in this respect, the present invention addresses this need and interest.

SUMMARY OF THE INVENTION

In view of the foregoing disadvantages inherent in the known types of stackable container assemblies now present in the prior art, the present invention provides an improved stackable container assembly. As such, the general purpose of the present invention, which will be described subsequently in greater detail, is to provide a new and improved stackable container assembly which has all the advantages of the prior art stackable container assemblies and none of the disadvantages.

To attain this, representative embodiments of the concepts of the present invention are illustrated in the drawings and make use of a stackable container assembly which includes a plurality of equal diameter cylindrical containers. A connector for securing the containers in coaxial stacked relation includes first and second cylindrical side walls which intersect at a transverse circular partition. Circular undercut grooves are provided on each of the side walls and are dimensioned to frictionally engage top and bottom peripheral rims on the containers. The connector may form a removable lid for one of the containers and may be utilized to package snack food items for marketing.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved stackable container assembly which has all the advantages of the prior art stackable container assemblies and none of the disadvantages.

It is another object of the present invention to provide a new and improved stackable container assembly which may be easily and efficiently manufactured and marketed.

It is a further object of the present invention to provide a new and improved stackable container assembly which is of a durable and reliable construction.

An even further object of the present invention is to provide a new and improved stackable container assembly which is susceptible of a low cost of manufacture with regard to both materials and labor, and which accordingly is then susceptible of low prices of sale to the consuming public, therebY making such stackable container assemblies economically available to the buying public.

Still yet another object of the present invention is to provide a new and improved stackable container assembly which provides in the apparatuses and methods of the prior art some of the advantages thereof, while simultaneously overcoming some of the disadvantages normally associated therewith.

Still another object of the present invention is to provide a new and improved stackable container assembly which allows individual serving units of food items to be conveniently transported.

Yet another object of the present invention is to provide a new and improved stackable container assembly which utilizes a connector which also functions as a removable container lid.

Even still another object of the present invention is to provide a new and improved stackable container assembly which includes a connector formed from a resilient material and including a pair of circular undercut grooves dimensioned for engagement with top and bottom rims of a pair of vertically stacked containers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
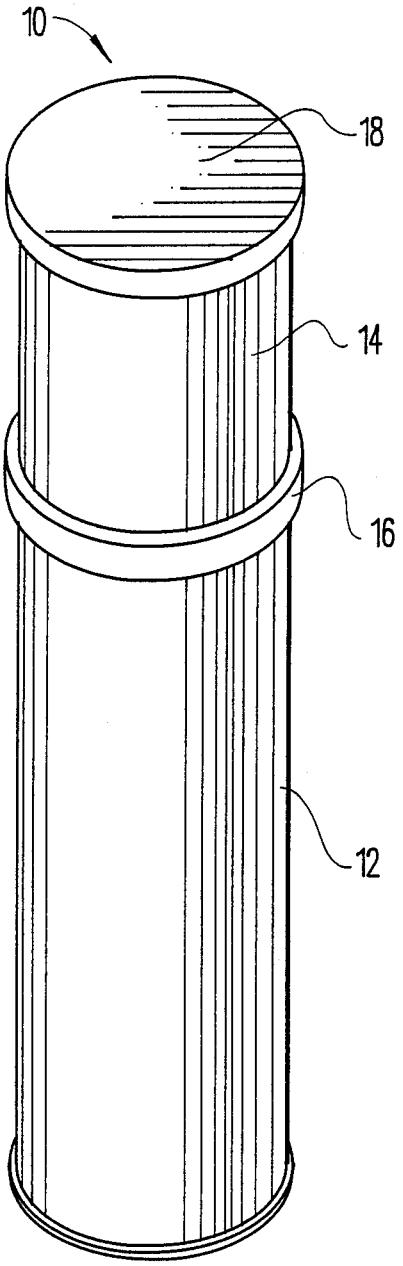
FIG. 1 is a perspective view of a stackable container assembly according to the first embodiment of the present invention.

With reference now to the drawings, and in particular to FIG. 1 thereof, a new and improved stackable container assembly embodying the principles and concepts of the present invention and generally designated by the reference numeral 10 will be described.

More specifically, it will be noted that the first embodiment 10 of the invention includes a pair of cylindrical containers 12 and 14 which are secured in coaxial vertically stacked relation by a connector 16. A removable resilient lid 18 is secured on an open upper portion of the container 14. The containers 12 and 14 may be formed from a paper board and foil construction as is conventionally utilized to package potato chips sold under the trademark PRINGLES. The container 12 is substantially longer than the container 14 and is dimensioned to store a relatively large quantity of a food item. The shorter container 14 is dimensioned to store an individual serving of a particular food item. In use, the containers 12 and 14 may be initially sold with both containers filled with a food item and sold as a single stacked container assembly. After the initial usage of the original quantity of the food item within the container 14, the container 14 may be repeatedly filled from the contents of the container 12, and utilized to transport a single serving quantity of a food item in a packed lunch.

Figure 2:
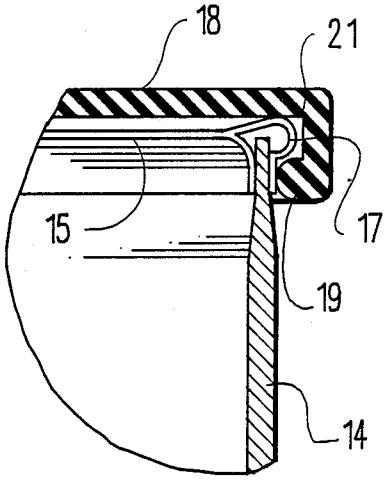
FIG. 2 is a partial cross sectional view illustrating a removable cover disposed on an uppermost container of the assembly.

FIG. 2 is a cross sectional detail view which illustrates a typical form of resilient reusable cover 18 utilized to reclose the container 14 after the initial opening. The container 14 includes a radially extending top rim 17 which is received in an undercut circular groove 21 provided on the interior surface of the cylindrical side wall of the cover 18. A radially inwardly extending circular rib 19 captures the rim 17 and secures the cover 18 over the open top 15 of the container 14.

Figure 3:
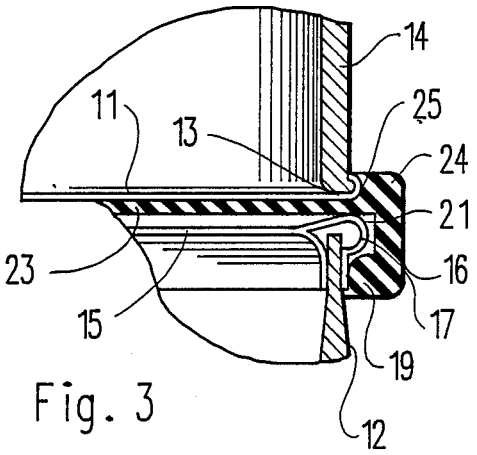
FIG. 3 is a partial cross sectional view which illustrates the container connector.

FIG. 3 is a cross sectional view which illustrates the constructional details of the connector 16. The connector 16 includes a circular transverse partition 23 which serves as a replaceable cover for the top opening 15 of the container 12. The connector 16 has first and second side wall portions which intersect at the circular partition 23. A first undercut circular groove 21 is formed on an interior surface of the first cylindrical side wall and is dimensioned to frictionally engage the top rim 17 of the container 12. A second undercut circular groove 25 is formed on an interior surface of the second cylindrical side wall 24 and is dimensioned to frictionally engage the bottom rim 13 of the container 14. The bottom rim 13 of the container 14 has a slightly smaller diameter than the top rim 17 of the container 12. The rim 17 is secured in sealing relation by a circular rib 19 provided on an interior surface of the second cylindrical side wall, adjacent the second undercut groove 21. Thus, the disengagement of the rim 17 from the groove 21 requires a larger force than the disengagement of the rim 13 from the groove 25. This allows the containers to be disassembled from stacked relation, without displacing the partition cover 23 from the open top 15 of the container 12.

Figure 4:
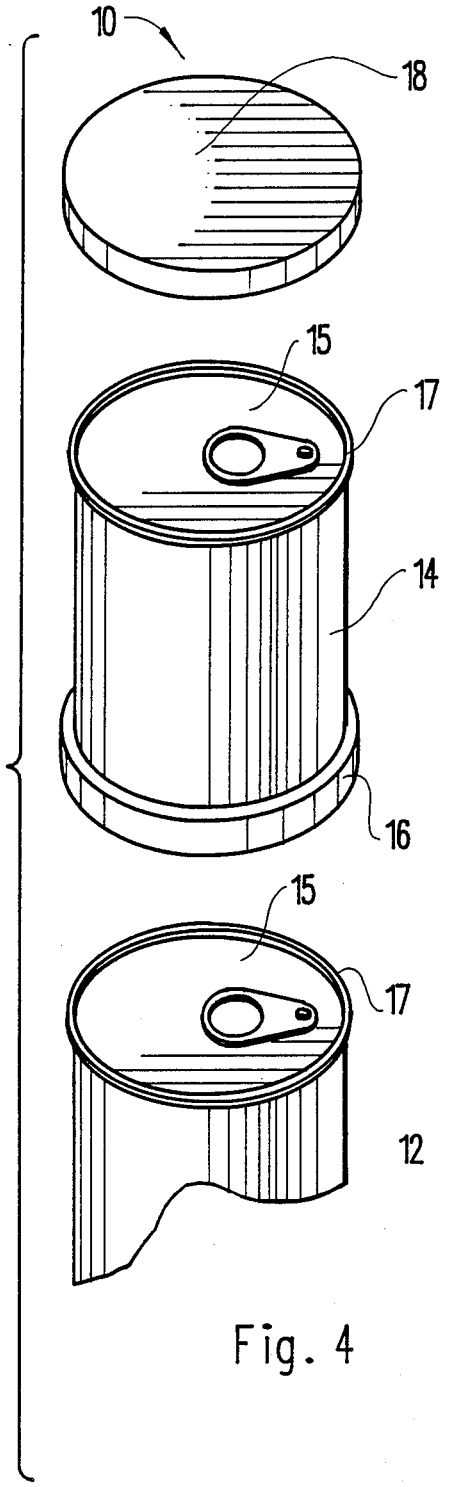
FIG. 4 is an exploded perspective view illustrating the container assembly of FIG. 1.

FIG. 4 is an exploded perspective view which illustrates the original metal foil seals 15 provided on the containers 12 and 14. After the initial removal of the seals 15 utilizing the illustrated conventional pull-tab openers, the connector 16 forms a removable cover for the container 12 and a resilient removable cover 18 is provided for the container 14.

Figure 5:
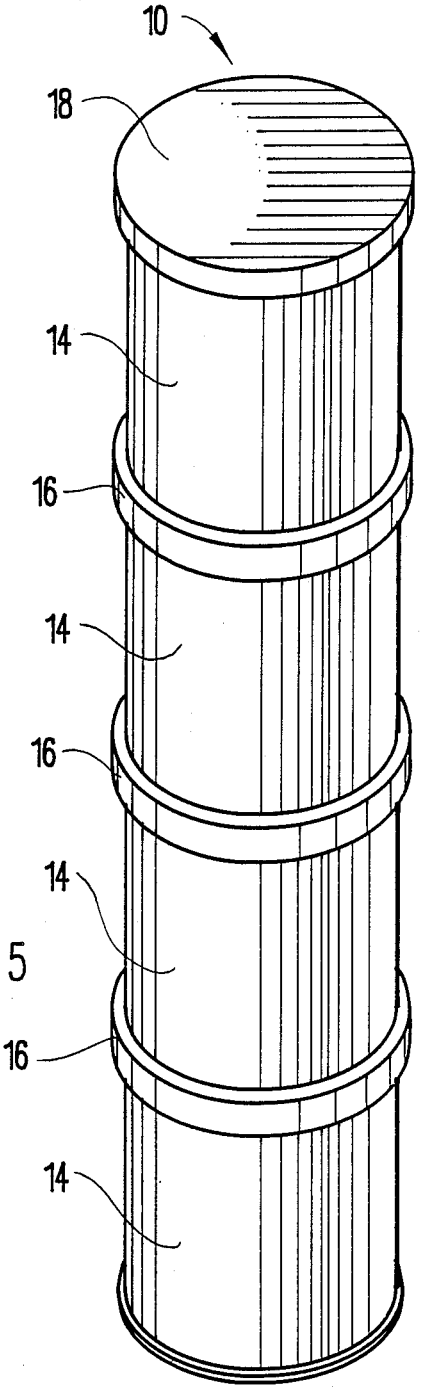
FIG. 5 is a perspective view illustrating a stacked container assembly utilizing a plurality of individual food serving containers secured in coaxial relation.

FIG. 5 illustrates a slightly different arrangement in which a plurality of individual serving size containers 14 are secured as an integral unit in a vertically stacked relation utilizing a plurality of connectors 16. This forms a convenient packaging unit and allows convenient removal of the individual containers 14.

Figure 6:
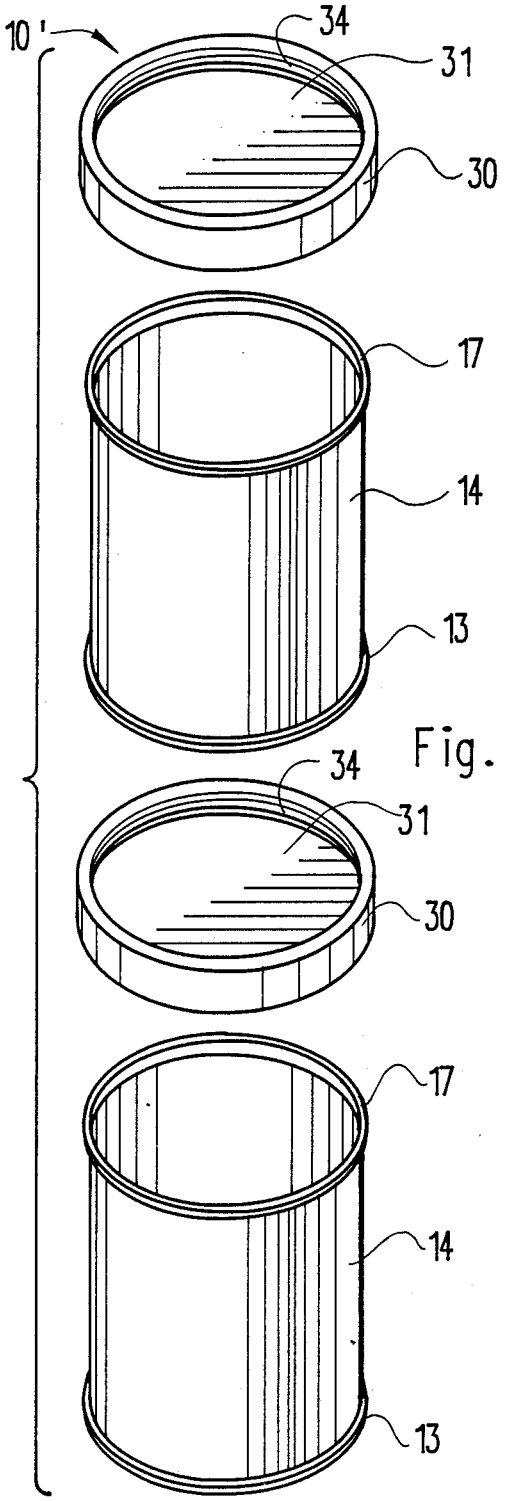
FIG. 6 is an exploded perspective view which illustrates a stacked container assembly utilizing a modified connector according to a second embodiment of the present invention.

FIG. 6 illustrates an exploded perspective view of a stacked container assembly according to a second embodiment 10' of the present invention. A pair of cylindrical containers 14 including top 17 and bottom 13 radially outwardly extending rims are secured in a vertically stacked coaxial relation by connectors 30. The connectors 30 are each provided with a transverse circular partition 31 and an interior circular undercut groove 34.

Figure 7:
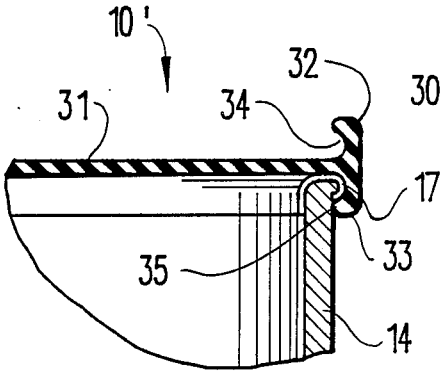
FIG. 7 is a partial cross sectional view illustrating the construction of the connector utilized in the assembly of FIG. 6.

As shown in the cross sectional view of FIG. 7, the connector 30 includes first 32 and second 33 cylindrical side wall portions which intersect at a transverse circular partition 31. First 34 and second 35 circular undercut grooves are formed on interior surfaces of the cylindrical side walls 32 and 33 and are dimensioned to engage the top 17 and bottom 13 rims of a pair of stacked containers 14. The container 30 has a plane of mirror symmetry extending parallel with the plane of the circular partition 31. The grooves 34 and 35 are identically dimensioned, as the rims 17 and 13 have equal dimensions.

Figure 8:
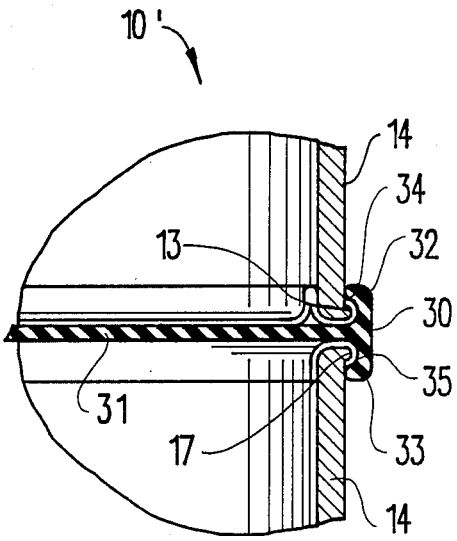
FIG. 8 is an additional partial cross sectional view illustrating the connector of the assembly of FIG. 6.

FIG. 8 is an additional cross sectional view which illustrates a pair of containers 14 secured in coaxial vertically stacked relation by the connector 30. The top rim 17 is received in the groove 35 and the bottom rim 13 is received in the groove 34. The partition 31 serves as a cover for the top opening of the container 14.

With respect to the above description then, it is to be realized that the optimum dimensional relationships for the parts of the invention, to include variations in size, materials, shape, form, function and manner of operation, assembly and use, are deemed readilY apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordinglY, all suitable modifications and equivalents may be resorted to, falling within the scope of the invention.

What is claimed as being new and desired to be protected by LETTERS PATENT of the United States is as follows:

1. A stackable container assembly, comprising:

a pair of cylindrical containers;

each of said containers having top and bottom radially extending circular rims;

a connector for securing said containers in coaxial stacked relation;

said connector formed from a resilient material and having a planar circular partition, said partition forming a cover for a top opening of one of said containers;

first and second cylindrical side walls extending around a peripheral edge of said circular partition, said first and second cylindrical side walls extending in opposite axial directions and intersecting at said circular partition;

a first undercut circular groove formed on an interior surface of said first cylindrical side wall, said first grove dimensioned to frictionally engage said top rim of one of said containers;

a second undercut circular groove formed on an interior surface of said second cylindrical side wall, said second grove dimensioned to frictionally engage said bottom rim of one of said containers, whereby said containers may be retained in coaxial stacked relation;

said container bottom rims having a smaller diameter than said container top rims and said connector including a radially inwardly extending circular rib having an arcuate transverse cross sectional shape and disposed on said second cylindrical side wall, adjacent said first undercut circular groove;

said first undercut groove having a greater depth than said second undercut groove such that disengagement of said container top rim from said first undercut groove requires a larger force than the disengagement of the container bottom rim from said second undercut groove, whereby said containers may be disassembled from stacked relation, without displacing said partition from said container top opening.

2. A connector for connecting a plurality of cylindrical containers, each having circular top and bottom rims and a top opening, to form a stacked container assembly, comprising:

said connector formed from a resilient material and having a planar circular partition, said partition dimensioned for forming a cover for a top opening of a container;

first and second cylindrical side walls extending around a peripheral edge of said circular partition, said first and second cylindrical side walls extending in opposite axial directions and intersecting at said circular partition;

a first undercut circular groove formed on an interior surface of said first cylindrical side wall, said first grove dimensioned to frictionally engage a top rim of a container;

a second undercut circular groove formed on an interior surface of said second cylindrical side wall, said second grove dimensioned to frictionally engage a bottom rim of one of said containers, whereby containers may be retained in coaxial stacked relation;

said connector including a radially inwardly extending circular rib having an arcuate transverse cross sectional shape and disposed on said second cylindrical side wall, adjacent said first undercut circular groove; and said first undercut groove having a greater depth than said second undercut groove such that disengagement of a container top rim from said first undercut groove requires a larger force than the disengagement of a container bottom rim from said second undercut groove, whereby containers may be disassembled from stacked relation, without displacing said partition from a container top opening.

* * * * *